US007987676B2

(12) United States Patent
Ast et al.

(10) Patent No.: US 7,987,676 B2
(45) Date of Patent: Aug. 2, 2011

(54) TWO-PHASE EXPANSION SYSTEM AND METHOD FOR ENERGY RECOVERY

(75) Inventors: Gabor Ast, Bavaria (DE); Thomas Johannes Frey, Bavaria (DE); Herbert Kopecek, Hallbergmoos (DE); Michael Adam Bartlett, Stockholm (SE); Pierre Sebastien Huck, Bavaria (DE)

(73) Assignee: General Electric Company, Niskayuna, NY (US)

( * ) Notice: Subject to any disclaimer, the term of this patent is extended or adjusted under 35 U.S.C. 154(b) by 436 days.

(21) Appl. No.: 12/274,608

(22) Filed: Nov. 20, 2008

(65) Prior Publication Data

US 2010/0122534 A1 May 20, 2010

(51) Int. Cl.
*F01K 25/08* (2006.01)

(52) U.S. Cl. ..... 60/651; 60/653; 60/671; 60/677; 60/679

(58) Field of Classification Search ..... 60/653, 60/677–680, 651, 671
See application file for complete search history.

(56) References Cited

U.S. PATENT DOCUMENTS 4,185,465 A * 1/1980 Shaw ..... 60/678
2005/0056001 A1* 3/2005 Frutschi et al. ..... 60/39.182
2008/0141673 A1 6/2008 Lehar et al.

OTHER PUBLICATIONS

I. Smith et al., "Trilaktekal Flash Cycle System A High Efficiency Power Plant For Liquid Resources," City University, London, Paper, pp. 2109-2114.

I. Smith et al., "Power Recovery From Low Cost Two-Phase Expanders," City University London, Paper, 8 pages.

G. Ast et al., "Method for Lubricating Screw Expanders and System for Controlling Lubrication," U.S. Appl. No. 12/187,426, filed Aug. 7, 2008.

M. Lehar et al., System and Method for Recovering Waste Heat, U.S. Appl. No. 11/770,895, filed Jun. 29, 2007.

G. Ast et al., "System and Method for Controlling an Expansion System," U.S. Appl. No. 11/956,457, filed Dec. 14, 2007.

* cited by examiner

*Primary Examiner* — Hoang M Nguyen
(74) *Attorney, Agent, or Firm* — Ann M. Agosti

(57) ABSTRACT

A closed loop expansion system for energy recovery includes a heat exchanger for using heat from a heat source to heat a working fluid of the closed loop expansion system to a temperature below the vaporization point of the working fluid; a radial inflow expander for receiving the working fluid from the heat exchanger and for expanding and partially vaporizing the working fluid; a screw expander for receiving the working fluid from the radial inflow turbine and for further expanding and vaporizing the working fluid; and a condenser for receiving the working fluid from the screw expander and for liquefying the working fluid.

22 Claims, 2 Drawing Sheets

TWO-PHASE EXPANSION SYSTEM AND METHOD FOR ENERGY RECOVERY

BACKGROUND

The subject matter disclosed herein relates generally to energy recovery systems.

In many closed loop expansion systems, a working fluid is heated to a temperature above its boiling point before being expanded to extract energy (work). A trilateral flash cycle, in contrast, is a thermodynamic cycle for extracting work from a heat source wherein the working fluid is heated to a temperature below its boiling point before being provided to a turbine (expander) to extract energy. During expansion, a large portion of the fluid (10-100%) typically flashes to a vapor state, causing a very large volume ratio (of volume flow per second at the exit over volume flow per second at the inlet). This volume ratio is problematic for all types of turbomachinery. Practically, the volume ratio (and hence pressure ratio) must be limited along with the work output. These constraints lower the thermodynamic efficiency when dealing with higher temperature waste heat.

It would be desirable to have an energy recovery system with higher power output and cycle efficiencies.

BRIEF DESCRIPTION

In accordance with one embodiment disclosed herein, a closed loop expansion system for energy recovery comprises: a heat exchanger for using heat from a heat source to heat a working fluid of the closed loop expansion system to a temperature below the vaporization point of the working fluid; a radial inflow expander for receiving the working fluid from the heat exchanger and for expanding and partially vaporizing the working fluid; a screw expander for receiving the working fluid from the radial inflow turbine and for further expanding and vaporizing the working fluid; and a condenser for receiving the working fluid from the screw expander and for liquefying the working fluid.

In accordance with another embodiment disclosed herein a power generation system comprises: a gas turbine and a closed loop expansion system for energy recovery comprising: a heat exchanger for using heat from the gas turbine to heat a working fluid of the closed loop expansion system to a temperature below the vaporization point of the working fluid; a radial inflow expander for receiving the working fluid from the heat exchanger and for expanding and partially vaporizing the working fluid; a screw expander for receiving the working fluid from the radial inflow expander and for further expanding and vaporizing the working fluid; and a condenser for receiving the working fluid from the screw expander and for liquefying the working fluid.

In accordance with another embodiment disclosed herein an energy recovery method comprising repeating the following sequence of steps while pumping working fluid through a closed loop expansion system: using heat from a heat source to heat a working fluid of the closed loop expansion system to a temperature below the vaporization point of the working fluid; expanding and partially vaporizing the heated working fluid in a first expander and then further expanding and vaporizing the partially vaporized working fluid in a second expander; converting mechanical power from the first expander, the second expander, or the first and second expanders into electrical power; and condensing the further expanded and vaporized working fluid.

DRAWINGS

These and other features, aspects, and advantages of the present invention will become better understood when the following detailed description is read with reference to the accompanying drawing, wherein.

DETAILED DESCRIPTION

Figure 1:
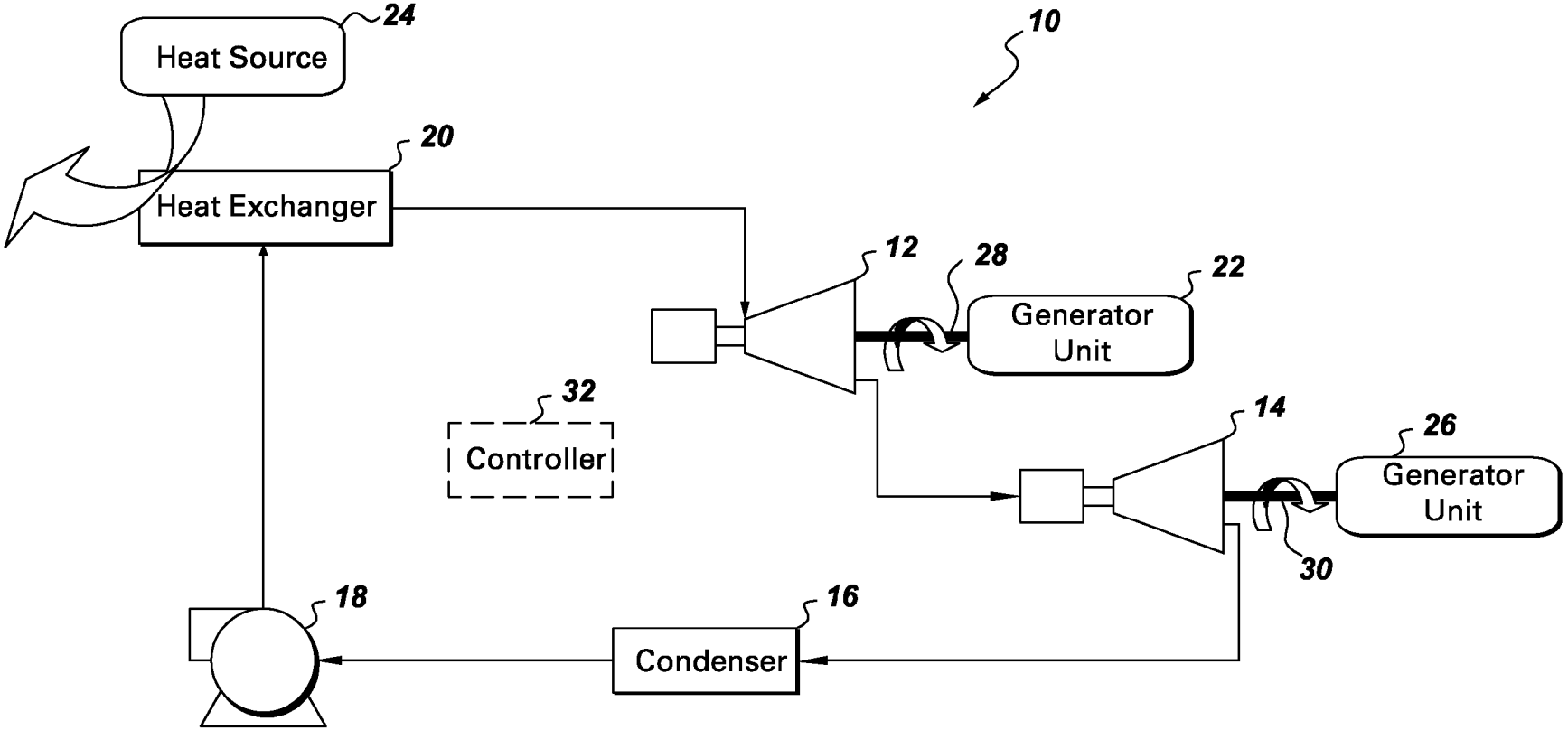
FIG. 1 is a block diagram of a closed loop expansion system for energy recovery in accordance with one embodiment described herein.

In accordance with embodiments disclosed herein, as shown in the FIG., a closed loop expansion system 10 for energy recovery comprises: a heat exchanger 20 for using heat from a heat source 24 to heat a working fluid of closed loop expansion system 10 to a temperature below the vaporization point of the working fluid; a radial inflow expander (or turbine) 12 for receiving the working fluid from heat exchanger 20 and for expanding and partially vaporizing the working fluid; a screw expander (or turbine) 14 for receiving the working fluid from radial inflow expander 12 and for further expanding and vaporizing the working fluid; and a condenser 16 for receiving the working fluid from screw expander 14 and for liquefying the working fluid. In these embodiments, radial inflow expander 12 receives the working fluid in a liquid state while screw expander 14 receives a two phase (liquid and vapor) combination of the working fluid to enable trilateral flash cycles in cyclically peaking applications with a larger volume ratio than either expander could provide alone and hence to provide higher power output and cycle efficiency.

Unless defined otherwise, technical and scientific terms used herein have the same meaning as is commonly understood by one of skill in the art to which this invention belongs. Also, the terms "a" and "an" do not denote a limitation of quantity, but rather denote the presence of at least one of the referenced item, and the modifier "about" used in connection with a quantity is inclusive of the stated value and has the meaning dictated by the context (e.g., includes the degree of error associated with measurement of the particular quantity).

Although embodiments described herein may be used for a variety of systems, such embodiments are believed to be particularly beneficial for heat sources or loads comprising cyclically operated heat-generating systems. Examples of sources which may operate cyclically include gas turbines, gas engines, combustors, chemical processing systems, geothermal heat sources, solar thermal heat sources, or combinations thereof.

In a more specific example, heat source 24 comprises a gas turbine, and heat exchanger 20 is situated for receiving heat from an exhaust stream of the gas turbine. In such embodiments, the resulting heat is variable due to gas turbine peaking and cyclical operating conditions.

In one embodiment, the working fluid comprises water. Other example working fluids include alcohol, hydrocarbons, alkanes, fluorohydrocarbons, ketones, aromatics, or combinations of the foregoing with or without water.

Heat exchanger 20 is used to heat the working fluid to a temperature near its saturation point. In the gas turbine example, hot gasses from the gas turbine are directed over vertical or horizontal tubes in the heat exchanger through which the working fluid flows. Because heat exchanger 20 need not vaporize the working fluid, requirements on heat exchanger 20 are less significant than for more typical systems that require such vaporization. For example, the system may be able to start recovering energy in a shorter time as compared with systems that require vaporization. In one embodiment, heat exchanger 20 is configured for providing a working fluid temperature that ranges from about one degree Celsius to about fifty degrees Celsius below the working fluid's boiling point.

In a radial inflow expander, the working fluid passes from the outer diameter of the turbine assembly (not shown) inward and exits the turbine rotor at a smaller diameter. The incoming fluid usually passes through a set of nozzles that cause the fluid to swirl and thereby enter the turbine rotor at the proper relative velocity. The flow then continues through the rotor where it continues to expand and impart energy to the rotor. The fluid then leaves the rotor near the rotational centerline. In some designs the inlet nozzles are replaced with an inlet scroll sized to provide the swirl to the rotor.

Screw expanders typically include a pair of meshing helical rotors (not shown) in a casing that surrounds the rotors. As the rotors rotate, the volume of fluid trapped between the rotors and the casing changes and either increases or decreases, depending on the direction of rotation, until the fluid is expelled. Power is transferred between the fluid and the rotor shafts by pressure on the rotors, which changes with the fluid volume. Screw expanders are sometimes referenced Lysholm machines due to the types of rotors (screws) that are typically used. In one embodiment, screw expander 14 is configured for completely vaporizing the working fluid. In another embodiment, screw expander 14 is configured for increasing the vaporization of the working fluid without completely vaporizing the working fluid.—Although a single screw expander is illustrated for purposes of example, in another embodiment, the screw expander includes a series of parallel screw expanders (not shown) coupled to receive the working fluid from the radial expander. Multiple screw expander embodiments are particularly beneficial for larger waste heat recovery systems.

Condenser 16 is used to condense the working fluid from its vaporized or partially vaporized state back into the working fluid's liquid state. Use of cooling water is common in such condensation systems, but any appropriate condensation technique may be employed.

Pump 18 may comprise any suitable pump capable of circulating the working fluid through heat exchanger 20, radial inflow and screw expanders 12 and 14, and condenser 16. In one embodiment, pump 18 is situated between condenser 16 and heat exchanger 20.

In one embodiment, closed loop expansion system 10 includes at least one generator unit 22 or 26 coupled to at least one of the radial inflow and the screw expanders 12 and 14 for receiving mechanical work and converting the mechanical work to electrical power. In a more specific embodiment, the at least one generator unit is coupled to both of the radial inflow and screw expanders either to one generator unit on a common or linked shaft (not shown) or via two shafts 28 and 30 to two separate generator units 22 and 26. A controller 32 may be used to control various aspects of the system components such as the rate of heat exchange of heat exchanger 20, operation of pump 18, condenser 16, and expanders 12 and 14, and energy conversion at the generator units.

Figure 2:
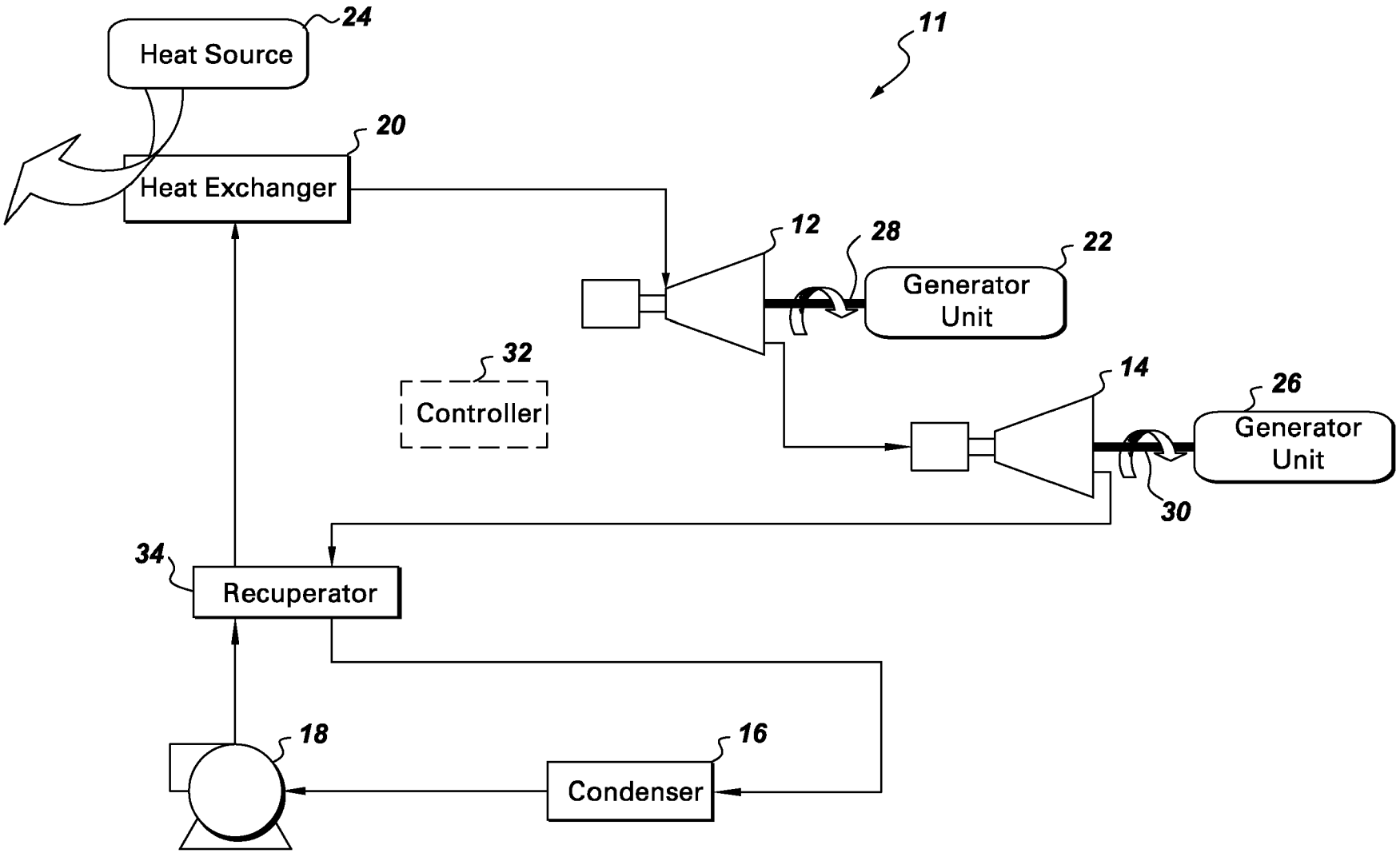
FIG. 2 is a block diagram of a closed loop expansion system for energy recovery in accordance with another embodiment described herein.

FIG. 2 is a block diagram of a closed loop expansion system 11 for energy recovery in accordance with an embodiment further comprising a recuperator (or heat exchanger) 34 for using heat from the working fluid from screw expander 14 to increase the temperature of the working fluid from pump 18. In this embodiment, heat is transferred from the working fluid exiting screw expander 14 to preheat the condensed working fluid being pumped to heat exchanger 20.

EXAMPLE

In one specific example, for purposes of illustration only, water is used as the working fluid, heat source 20 includes exhaust gas at about 530 degrees Celsius, heat exchanger uses the heat from the exhaust gas to heat the working fluid from an input temperature of about 145 degrees Celsius to an output temperature of about 180 degrees Celsius, radial inflow expander 12 has operating parameters of power at about 5600 kilowatts, mass flow at about 121 kilograms per second, inlet pressure at about 130 bars, temperature at about 245 degrees Celsius, and vapor quality (evaporation rate) of about 29%, screw expander 14 has operating parameters of power at about 11800 kilowatts, outlet pressure at about 4 bars or 5 bars, temperature at about 148 degrees Celsius, and vapor quality (evaporation rate) of about 40%, the condensation temperature in condenser 16 is about 15 degrees Celsius, and the pump has operating parameters of power at about 1350 kilowatts, temperature of about 145 degrees Celsius, and resulting pressure of about 4 bars.

As discussed above, the embodiments disclosed herein are expected to provide a low temperature waste recovery system that is adaptable to changing heat/load conditions with increased power efficiency and capabilities of starting heat recovery faster than in vapor-based inlet expansion systems. Additional advantages may include ability to operate without a deaerator and ability to operate without or with less boiler control. In embodiments wherein the working fluid is water, film temperature concerns will be reduced due to reduced variation in temperature across the diameter of the pipes that carry the working fluid.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A closed loop expansion system for energy recovery comprising:

a heat exchanger for using heat from a heat source to heat a working fluid of the closed loop expansion system to a temperature below the vaporization point of the working fluid;

a radial inflow expander for receiving the working fluid from the heat exchanger and for expanding and partially vaporizing the working fluid;

a screw expander for receiving the working fluid from the radial inflow turbine and for further expanding and vaporizing the working fluid;

a condenser for receiving the working fluid from the screw expander and for liquefying the working fluid.

2. The system of claim 1 wherein the heat source comprises a cyclically operated power generation system.

3. The system of claim 1 wherein the heat source comprises a gas turbine, a gas engine, a combustor, a chemical processing system, a geothermal heat source, a solar thermal heat source, or a combination thereof.

4. The system of claim 1 further comprising at least one generator unit coupled to at least one of the radial inflow and the screw expanders for receiving mechanical work and converting the mechanical work to electrical power.

5. The system of claim 4 wherein the at least one generator unit is coupled to both of the radial inflow and screw expanders.

6. The system of claim 4 wherein the at least one generator unit comprises a first generator unit coupled to the radial inflow expander and a second generator unit coupled to the screw expander.

7. The system of claim 1 wherein the working fluid comprises water.

8. The system of claim 1 wherein the working fluid comprises water, alcohol, a hydrocarbon, an alkane, a fluorohydrocarbon, a ketone an aromatic, or combinations thereof.

9. The system of claim 1 wherein the screw expander is configured for completely vaporizing the working fluid.

10. The system of claim 1 wherein the screw expander is configured for increasing the vaporization of the working fluid without completely vaporizing the working fluid.

11. The system of claim 1 further comprising a pump for circulating the working fluid through the heat exchanger, the radial inflow and screw expanders, and the condenser.

12. The system of claim 11 wherein the pump is situated between the condenser and the heat exchanger.

13. The system of claim 11 further comprising a recuperator for using heat from the working fluid from the screw expander to increase the temperature of the working fluid from the pump.

14. A power generation system comprising:

a gas turbine;

a closed loop expansion system for energy recovery comprising:

a heat exchanger for using heat from the gas turbine to heat a working fluid of the closed loop expansion system to a temperature below the vaporization point of the working fluid;

a radial inflow expander for receiving the working fluid from the heat exchanger and for expanding and partially vaporizing the working fluid;

a screw expander for receiving the working fluid from the radial inflow expander and for further expanding and vaporizing the working fluid;

a condenser for receiving the working fluid from the screw expander and for liquefying the working fluid.

15. The power generation system of claim 14 wherein the heat exchanger is situated for receiving heat from an exhaust stream of the gas turbine.

16. The power generation system of claim 14 further comprising at least one generator unit coupled to at least one of the radial inflow and the screw expanders for receiving mechanical work and converting the mechanical work to electrical power.

17. The power generation system of claim 16 wherein the at least one generator unit is coupled to both of the radial inflow and screw expanders.

18. The power generation system of claim 16 wherein the at least one generator unit comprises a first generator unit coupled to the radial inflow expander and a second generator unit coupled to the screw expander.

19. The power generation system of claim 14 wherein the working fluid comprises water.

20. The power generation system of claim 14 further comprising a pump for circulating the working fluid through the heat exchanger, the radial inflow and screw expanders, and the condenser, wherein the pump is situated between the condenser and the heat exchanger.

21. The system of claim 20 further comprising a recuperator for using heat from the working fluid from the screw expander to increase the temperature of the working fluid from the pump.

22. An energy recovery method comprising repeating the following sequence of steps while pumping working fluid through a closed loop expansion system:

using heat from a heat source to heat a working fluid of the closed loop expansion system to a temperature below the vaporization point of the working fluid;

expanding and partially vaporizing the heated working fluid in a first expander and then further expanding and vaporizing the partially vaporized working fluid in a second expander;

converting mechanical work from the first expander, the second expander, or the first and second expanders into electrical power; and condensing the further expanded and vaporized working fluid.

* * * * *